United States Patent [19]

Jarrett et al.

[11] Patent Number: 4,804,286

[45] Date of Patent: Feb. 14, 1989

[54] ONE-HAND OPERABLE COSMETIC CONTAINER

[76] Inventors: Frank A. Jarrett, P.O. Box 7624, South Lake Tahoe, Calif. 95731; Maria Frimmel, 111 Barrington Walk, Los Angeles, Calif. 90049

[21] Appl. No.: 5,555

[22] Filed: Jan. 16, 1987

[51] Int. Cl.[4] ..... A45D 40/06; B41J 11/20

[52] U.S. Cl. ..... 401/59; 401/131; 401/88; 401/107

[58] Field of Search ..... 401/55, 59, 60, 80, 401/49, 62, 131, 82, 88, 107, 108, 99; 132/88.5, 88.7, 79 C; 220/332, 333, 334, 260; 206/385, 815; 222/386.5

[56] References Cited

U.S. PATENT DOCUMENTS 280,830 7/1883 Jameson ..... 222/386.5
2,079,002 5/1937 De Loeschnigg ..... 401/82
3,709,618 1/1973 Gruska ..... 401/59 X

FOREIGN PATENT DOCUMENTS 664853 4/1929 France ..... 401/59
940750 12/1948 France ..... 401/59
439284 9/1948 Italy ..... 401/59

*Primary Examiner*—Richard J. Apley
*Assistant Examiner*—Franklin L. Gubernick
*Attorney, Agent, or Firm*—Lyon & Lyon

[57] ABSTRACT

A one-hand operable cosmetic container includes a pair of cases pivotally mounted to a base. The cases are resiliently biased to a closed position wherein the product is enclosed by the cases. A trigger or tabs are provided for pivoting the cases to an open position wherein the product is exposed.

8 Claims, 4 Drawing Sheets

ONE-HAND OPERABLE COSMETIC CONTAINER

BACKGROUND

The field of the present invention is containers and dispensors for facial products such as lipstick and other cosmetics.

Lipstick and other types of facial products, whether oil or water based, or comprised of other constituents, must be appropriately contained if they are to be applied without soiling the hands, clothes, etc. of the user. The product must also be protected against breakage. In the past, containers developed for these products have required two-handed operation. For example, virtually all lipstick containers presently available comprise a base portion that supports the lipstick and a cap that fits over the base to enclose and protect the lipstick when not in use. In addition to requiring two-handed operation, such containers possess several disadvantages. First, the cap can become lost. Second, if the lipstick is dropped during use it can break and/or contact unwanted surfaces such as clothing, etc. A facial product container overcoming the above disadvantages would therefore be desirable.

SUMMARY

The present invention is directed to a one-hand operable container for facial products. To this end a base portion supports the product while pivotable cases are employed to enclose the product when not in use. Means are provided to pivot the cases between closed and open positions.

DETAILED DESCRIPTION OF PREFERRED EMBODIMENTS

Figure 1:
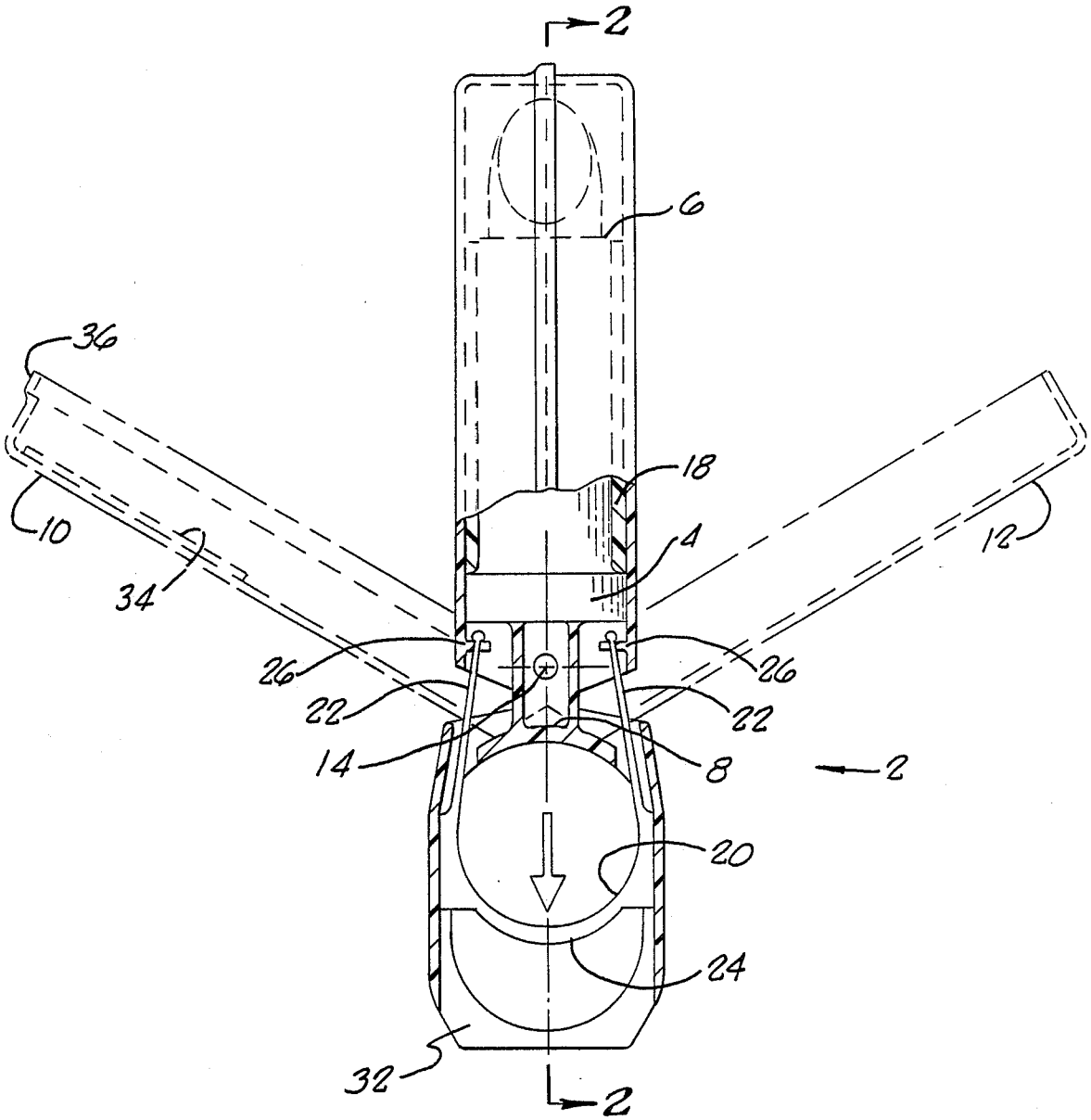
FIG. 1 is a plan view of a container constructed in accordance with the present invention, showing the container in closed and open positions.
Figure 2:
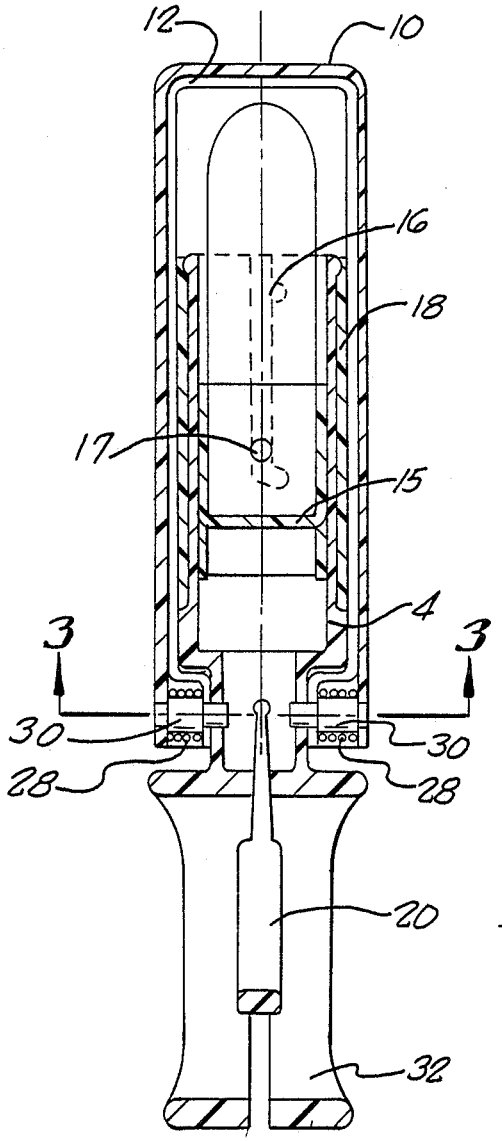
FIG. 2 is a cross-sectional view of the container shown in FIG. 1 taken along line 2—2 in said Figure.
Figure 7:
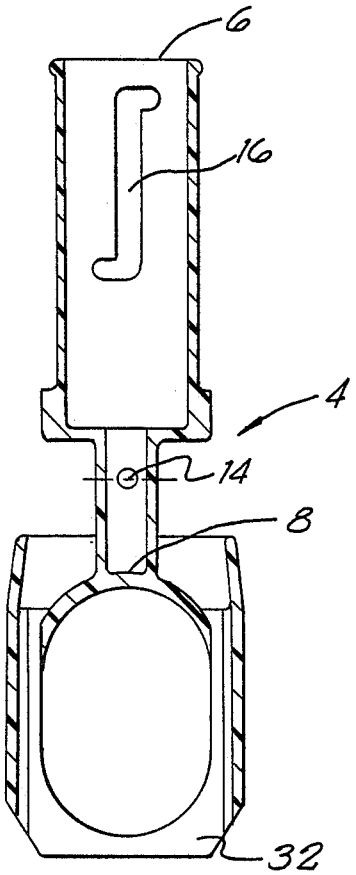
FIG. 7 is a plan view of a base or can member employed in the container of FIG. 1.

Turning in detail to the drawings, FIGS. 1 and 2 illustrate a container 2 comprising a base or can 4 that includes a first end portion 6 and a second end portion 8. The can 4 is shown in detail in FIG. 7. A pair of cases 10 and 12 are pivotally mounted on the can 4 at a common axis 14 located between the first and second end portions of the can 4. The can 4 and cases 10 and 12 are preferably injection-molded plastic but many other materials could also be used. If desired, the cases 10 and 12 could be a transparent material. The first end 6 of the can 4 is adapted to support a facial product, which would generally be available in stick form mounted in a holder or insert such as element 15. A slot 16 is disposed longitudinally in the can 4 and is adapted to receive tabs 17 extending from the holder 15. A sleeve 18 fits over the can 4 and has a spiral slot disposed in the interior surface thereof adapted to receive the tabs 17. Rotating the sleeve 18 thus causes the product to advance or retract longitudinally with respect to the can 4.

Figure 3:
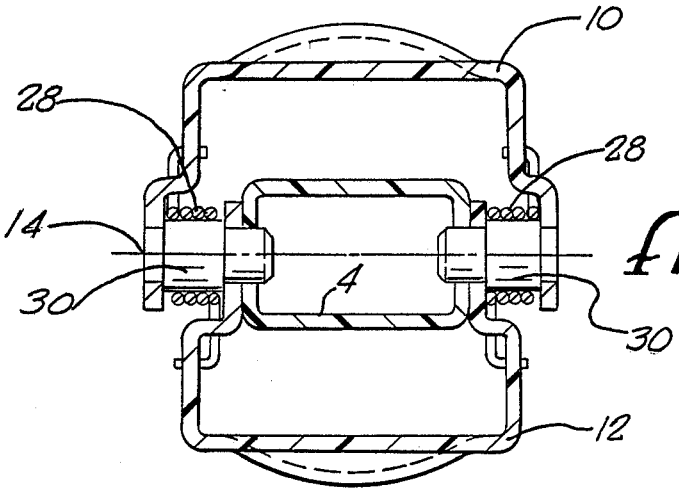
FIG. 3 is a cross-sectional view taken along line 3—3 in FIG. 2.

Associated with the can 4 are means for pivoting the cases 10 and 12 between a closed position wherein the cases enclose the product to an open position wherein the product is exposed. These positions are illustrated in FIG. 1 by solid and phantom lines, respectively. In the container of FIG. 1, pivoting is accomplished in part by an approximately U-shaped trigger 20 having arm portions 22 and a base portion 24. The arms 22 are engaged with the cases 10 and 12 at tabs 26. The tabs 26 are slotted and the arms 22 have enlarged ends to provide positive engagement with the tabs 26. Pulling the trigger in the direction indicated by the arrow causes the cases to open. To close the case a pair of springs 28 are provided. As shown in FIG. 3, the springs 28 are torsional in nature. They are mounted on a pair of pins 30 oriented along the common axis 14 which support the cases 10 and 12 in pivotal relation with the can 4. The torsion springs 28 are typically stainless steel although many other materials could also be used. The end portions of each spring are positioned to engage end portions of the cases 10 and 12, thereby resiliently joining the cases and urging them into a closed position. A trigger housing 32 mounted to the can 4 supports the trigger 20, which is slidably mounted therein, and provides a handle for the container 2.

To use the container, the user grasps the handle 32, places a finger over the trigger 20 and depresses the trigger. If desired one or more mirrors 34 can be mounted in the cases 10 and 12 to facilitate product application. When the container is not in use the facial product within will be enclosed by the cases 10 and 12. To ensure that the cases 10 and 12 fit snuggly together, the case 10 includes an enlarged inner lip 36 that fits over the inner edge of the case 12.

Figure 6:
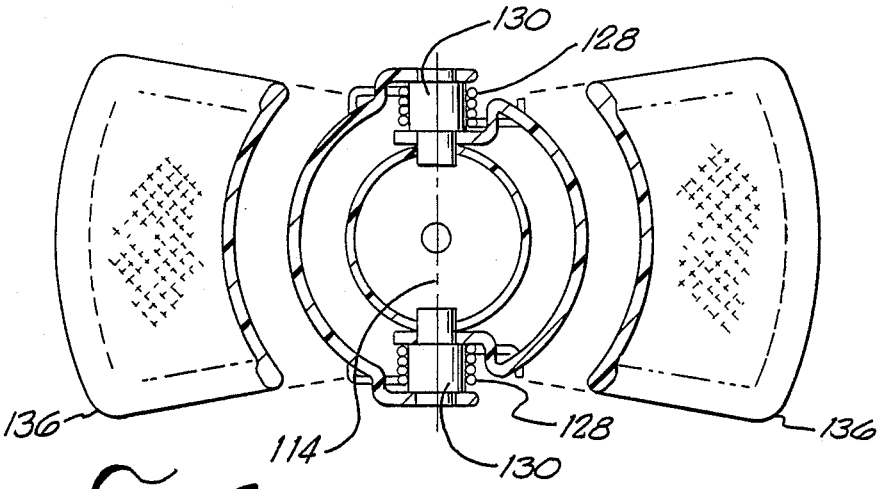
FIG. 6 is a cross-sectional view taken along line 6—6 in FIG. 4.
Figure 4:
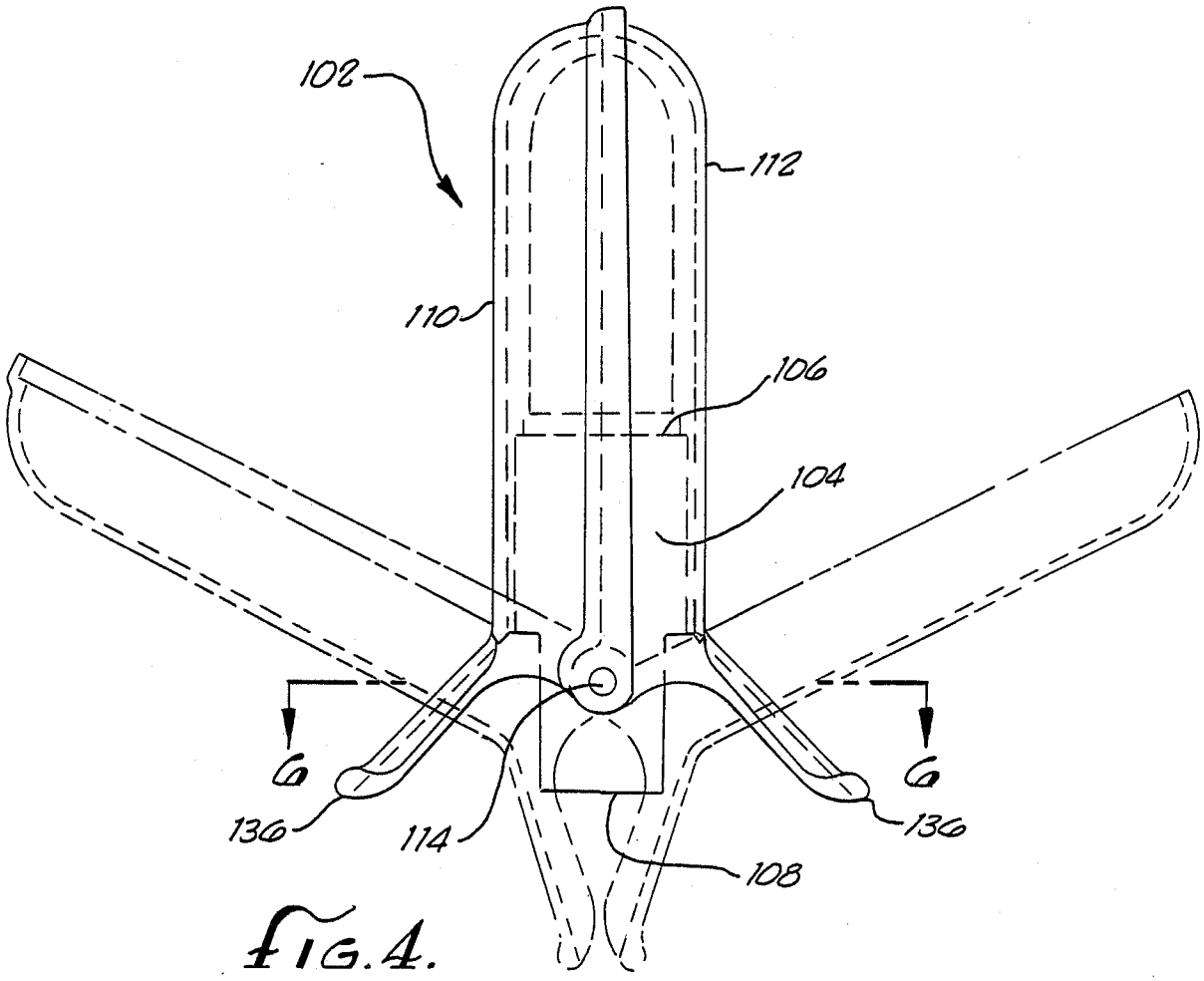
FIG. 4 is a plan view of a second container also constructed in accordance with the present invention, showing the container in closed and open positions.
Figure 5:
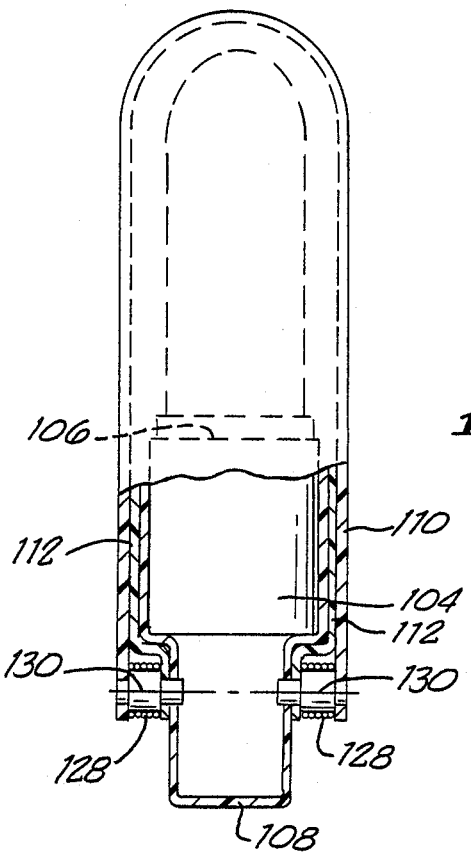
FIG. 5 is a side view of the container shown in FIG. 4.

FIGS. 4 through 6 depict a modified container 102 comprising a base or can 104 having a first end portion 106 and a second end portion 108. A pair of cases 110 and 112 are pivotally mounted on the can 104 at a common axis 114 located between the first and second end portions of the can 104. The first end 106 of the can 104 is adapted to support a facial product. The cases 110 and 112 are resiliently biased in a closed position by means of torsion springs 128. The springs 128 are mounted on pins 130 oriented along the common axis 114 which support the cases 110 and 112 in pivotal relation with the can 104. The end portions of each spring engages an end portion of the cases 110 and 112 thereby resiliently joining the cases and urging them into a closed position. A pair of gripping members 136 are mounted to the cases 110 and 112 and extend outwardly and downwardly such that pressing the gripping members together causes the cases 110 and 112 to pivot against the force of the springs 128. These positions are illustrated in FIG. 4 by solid and phantom lines, respectively.

Thus, a one-hand operable facial product container is disclosed. While embodiments have been shown and described, it would be apparent to those skilled in the art that many more modifications are possible without departing from the inventive concepts herein. The invention therefor, is not to be restricted except in the spirit of the appended claims.

What is claimed is:

1. A one-hand operable facial product container comprising:

a can having a first end portion adapted to support a product and a second end portion;

a pair of cases pivotally mounted by pin means on said can, said cases being pivotable between an open position wherein said first end of said can is exposed to a closed position wherein said cases enclose said first end of said can;

means for pivoting said cases between said open and closed positions; and means for resiliently biasing said cases into said closed position, said biasing means providing continuous positive biasing force on said cases toward said closed position, whereby when said means for pivoting said cases are operated to open said cases, said biasing means continue to urge said cases toward said closed position.

2. The container set forth in claim 1 wherein said case pivoting means comprise a pair of gripping members mounted to said cases extending away from said first and second end portions of said can and positioned to be grasped by a user of the container and pressed together in order to pivot said cases.

3. The container set forth in claim 1 wherein said case pivoting means include a trigger positively engaging said cases.

4. The container set forth in claim 3 further including a trigger housing mounted to said second end of said can.

5. The container set forth in claim 4 wherein said trigger is slidably mounted in said trigger housing.

6. The container set forth in claim 1 wherein said pin means comprise at least one pin and wherein said case biasing means include a torsion spring mounted on each said pin.

7. A one-hand operable facial product container comprising:

a can having a first end portion adapted to support a product and a second end portion;

a pair of cases pivotally mounted at a common axis on said can, said cases being pivotable between an open position wherein said first end of said can is exposed to a closed position wherein said cases enclose said first end of said can;

a trigger housing mounted to said second end portion of said can, said trigger housing having a central opening adapted to allow insertion of a finger;

a trigger slidably mounted in said trigger housing, said trigger having a central opening adapted to allow insertion of a finger for operating said trigger and being engaged with said cases to pivot said cases between said open and closed positions; and a pair of springs positively engaging both said cases, said springs biasing said cases into said closed position.

8. A one-hand operable facial product container comprising:

a can having a first end portion adapted to support a product and a second end portion;

a pair of cases pivotally mounted at a common axis on said can, said cases being pivotable between an open position wherein said first end of said can is exposed to a closed position wherein said cases enclose said first end of said can, said cases including a pair of gripping members extending away from said first and second end portions of said cases for pivoting said cases between said open and closed positions; and a pair of springs positively engaging both said cases, said springs biasing said cases into said closed position.

* * * * *